United States Patent [19]

Gerlach et al.

[11] 3,995,188

[45] Nov. 30, 1976

[54] GRID FOR AN ELECTRONIC TUBE

[75] Inventors: Pierre Gerlach; Gilles Bouvard, both of Paris, France

[73] Assignee: Thomson-CSF, Paris, France

[22] Filed: June 24, 1975

[21] Appl. No.: 589,887

[30] Foreign Application Priority Data

June 28, 1974 France ..... 74.22686

[52] U.S. Cl. ..... 313/348; 313/343

[51] Int. Cl.[2] ..... H01J 1/46; H01J 1/52; H01J 17/04; H01J 17/12

[58] Field of Search ..... 313/341, 343, 346, 348

[56] References Cited

UNITED STATES PATENTS

| | | | |
|---|---|---|---|
| 1,874,355 | 8/1932 | Round | 313/343 |
| 1,890,339 | 12/1932 | Romhild | 313/343 |
| 2,222,021 | 11/1940 | Etzrodt | 313/343 |
| 2,319,338 | 5/1943 | Mulder | 313/343 |
| 3,610,993 | 10/1971 | Randels | 313/348 |
| 3,824,424 | 7/1974 | McNees et al. | 313/3 H |

*Primary Examiner*—Saxfield Chatmon, Jr.
*Attorney, Agent, or Firm*—Roland Plottel

[57] ABSTRACT

A cylindrical grid for an electronic tube, a triode or tetrode, of high-power design. It is constituted by a mesh-type structure of pyrolytic graphite, the meshes being substantially of equilateral triangular shape in all cases.

6 Claims, 3 Drawing Figures

GRID FOR AN ELECTRONIC TUBE

The present invention relates to a grid for an electronic tube, in particular a high powered triode or tetrode.

Tubes of this kind conventionally contain a cylindrical cathode, one or more cylindrical grids, each constituted by two sheets of uniformly spaced wires wound helically with opposite hands and welded at their intersection points in order to form diamond-shaped meshes, and, finally, a cylindrical anode.

One difficulty encountered in the operation of tubes of this kind in high power transmitters, arises from mechanical vibrations which the grids undergo. In otherwords, because of the effect of the direct bias voltages and alternating modulating voltages applied to the various electrodes, the grid or grids is or are subjected to electrostatic forces capable of causing it/them to vibrate. The amplitude of the vibration is sometimes sufficient to bring it/them into contact with one another so that a short-circuit occurs, giving rise to operating problems and sometimes to the destruction of the tube. This difficulty is the greater the smaller the distances between the electrodes, however, to reduce these distances produces benefits of substantial order in terms of the gain of the device in particular.

The object of the present invention is to overcome this difficulty by giving the grids a structure such that the unwanted parasitic vibrations cannot develop under the normal conditions of operation of the tube. According to the invention, there is provided a grid for an electronic tube, said grid having a mesh-type structure, wherein the meshes are substantially triangular in shape.

The invention will be better understood from a consideration of the ensuing description and the related drawings in which.

Figure 1:
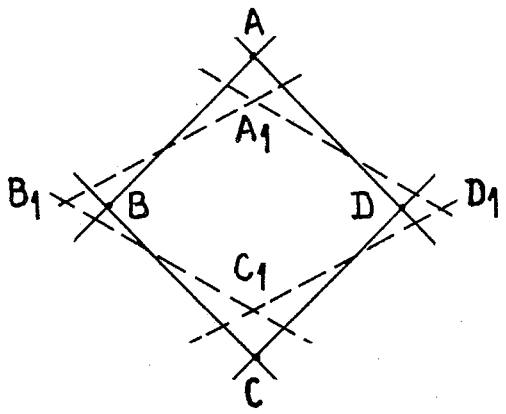
FIG. 1 and FIG. 2 are explanatory diagrams.

The diagram of FIG. 1 illustrates in full line a diamond shaped mesh belonging to a grid of known type, the diamond being referenced ABCD. In broken line a rectangle $A_1B_1C_1D_1$ has been shown illustrating a kind of deformation occurring in the plane of the mesh, which is particularly dangerous in electronic tubes, in particular where these latter are built using concentric cylindrical electrodes. In other words, under normal operating conditions of this kind of tube, vibrational modes corresponding to a variation in the diameter of the grids about their initial diameter, are readily excited. This variation can result in contact taking place within the electrodes. This risk is obviously particularly severe in the case where the distance between the electrodes is very small.

Figure 2:
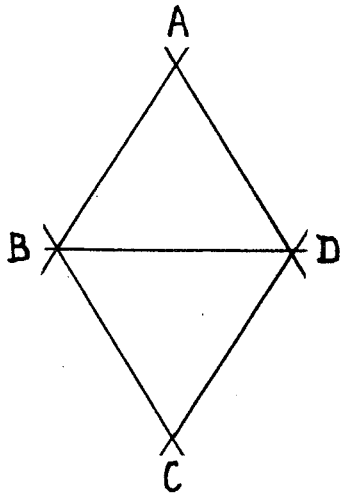

The diagram of FIG. 2 illustrates two meshes of the grid in accordance with the invention: The corners B and D are linked by a bar which makes the kind of distortion $A_1B_1C_1D_1$ impossible and therefore rules out the particular type of vibration which produces it.

Figure 3:
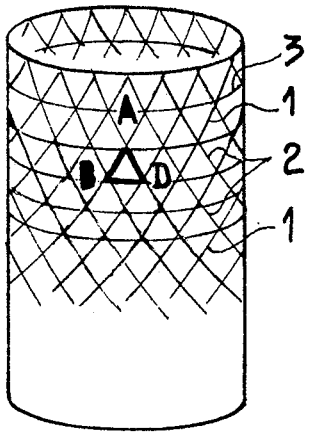
FIG. 3 is a diagram of an embodiment of the grid in accordance with the invention.

The grid thus constituted by a set of triangular meshes such as those ABD, is shown in FIG. 3.

The dimensions of the triangles ABD, that is to say the length of the sides and the cross-section of the bars which go to make them up, are chosen in such a fashion as to give the grid the kind of electron-transparency which corresponds with the desired characteristics of the overall tube. It should be pointed out that, in particular where the width of the bars and the total number of meshes, thus the surface area of each one, are fixed by technological considerations, the maximum transparency is achieved when the meshes are equilateral triangles.

In a first embodiment, the grid in accordance with the invention takes for example a cylindrical form and is built using three sheets of parallel, uniformly spaced wires, the wires in the two first sheets, that is to say the wires 1 and 2 in FIG. 3, being wound in the form of helices with hands opposite relating to that of the wires in the third sheet (wires 3 in FIG. 3). The wires are moreover wound together at their intersection points (A, B, D).

Another preferred embodiment of the grid in accordance with the invention consists in forming triangular openings in a cylindrical sheet of pyrolytic graphite.

Those skilled in the art will be aware that pyrolytic graphite, also known as "orientated graphite," is a crystallised carbon obtained by the thermal decomposition of a gaseous combination of carbon in contact with the surface of a substrate raised to a high temperature. The utilisation for the manufacture of electronic tube electrodes, of a material of this kind in the form of flat sheets or sheets with a double or single curvature, such as the cylinder shown in FIG. 3, yields major advantages both from the thermal and electronic points of view, amongst which one can point in particular to the very excellent electrical and thermal conductivity achieved in directions parallel to the major faces of the electrode. The utilisation of this material therefore makes it possible to reduce the interval between the various electrodes, this reduction generally being required anyway in order to improve the tube performance.

The triangular openings can be formed in a sheet of pyrolytic graphite by any of the known methods, and in particular in the manner described in Japanese Pat. No. 14.359.

The triangular structure of the grid in accordance with the invention makes it possible, as already mentioned above, to prevent variation in the diameters of the grids and consequently to reduce the risk of contact between the electrodes, and is therefore particularly well suited to application in this kind of tube.

It is accordingly possible to build electronic tubes in which the inter-electrode distances can be very small indeed, typically less than 1 mm, and which consequently have advantageous characteristics in the form of a high gain and a low input power.

The invention is consequently particularly well suited to triode and tetrode tubes of the kind used for high power transmitters.

What is claimed is:

1. A grid for an electronic tube, said grid having substantially the shape of a cylinder and a mesh-type structure, wherein the meshes are substantially triangular in shape each triangular mesh having three sides, one of them constituting a part of a director circle of said cylinder.

2. A grid as claimed in claim 1, wherein said triangles are substantially equilateral in shape.

3. A grid as claimed in claim 1, wherein said meshes are constituted by triangular openings in a sheet.

4. A grid as claimed in claim 3, wherein said sheet is a sheet of pyrolytic graphite.

5. A grid as claimed in claim 1, wherein said grid is constituted by three sheets of substantially parallel, uniformly spaced wires, the wires of two of said sheets making an angle other than zero with those of the third of said sheets in order to form triangles, said wires being attached to one another at the corners of said triangles.

6. A grid for an electronic tube, said grid having a mesh-type structure, wherein the meshes are substantially triangular in shape, and wherein said grid is constituted by three sheets of substantially parallel, uniformly spaced wires, the wires of two of said sheets making an angle other than zero with those of the third of said sheets in order to form triangles, said wires being attached to one another at the corners of said triangles.

* * * * *